US007690781B2

(12) United States Patent
Ohnishi

(10) Patent No.: US 7,690,781 B2
(45) Date of Patent: Apr. 6, 2010

(54) INK JET PRINTER USING UV INK

(75) Inventor: Masaru Ohnishi, Kawanishi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 10/558,129

(22) PCT Filed: May 21, 2004

(86) PCT No.: PCT/JP2004/007343

§ 371 (c)(1),
(2), (4) Date: Nov. 25, 2005

(87) PCT Pub. No.: WO2004/108417

PCT Pub. Date: Dec. 16, 2004

(65) Prior Publication Data

US 2007/0013757 A1 Jan. 18, 2007

(30) Foreign Application Priority Data

Jun. 4, 2003 (JP) ..... 2003-158917
Nov. 21, 2003 (JP) ..... 2003-391597

(51) Int. Cl.
*B41J 2/01* (2006.01)

(52) U.S. Cl. ..... 347/102; 347/101; 347/51

(58) Field of Classification Search ..... 347/102, 347/43, 95, 100, 51, 101, 107
See application file for complete search history.

(56) References Cited

U.S. PATENT DOCUMENTS 5,663,787 A * 9/1997 Haneda et al. ..... 399/111
5,784,666 A * 7/1998 Nagase et al. ..... 399/44
5,926,201 A * 7/1999 Fleming et al. ..... 347/237
5,946,010 A * 8/1999 Isobe et al. ..... 347/37
2001/0038408 A1* 11/2001 Codos et al. ..... 347/102
2003/0007065 A1* 1/2003 Driessen-olde Scheper et al. ..... 347/238
2003/0035037 A1* 2/2003 Mills et al. ..... 347/102
2003/0081096 A1* 5/2003 Young ..... 347/102
2004/0052076 A1* 3/2004 Mueller et al. ..... 362/293
2004/0090794 A1* 5/2004 Ollett et al. ..... 362/555
2005/0128274 A1* 6/2005 Matsushima et al. ..... 347/102
2005/0152146 A1* 7/2005 Owen et al. ..... 362/294

(Continued)

FOREIGN PATENT DOCUMENTS

EP 1 139 019 10/2001

(Continued)

*Primary Examiner*—Matthew Luu
*Assistant Examiner*—Henok Legesse
(74) *Attorney, Agent, or Firm*—Ditthavong Mori & Steiner, P.C.

(57) ABSTRACT

A UVLED (62) or a UVLED array unit (64) is employed in the UV-ray emitting body of a UV-ray irradiating means (60) for curing a UV-ink drop, shot at the surface of print media (50) mounted on a platen (20) from the ink jet head (30) of an ink jet, by irradiating it with UV-rays. Power consumption of the UV-ray irradiating means (60) is suppressed greatly, the UV-ray irradiating means (60) is reduced in size and weight or simplified, waiting time of the UV-ray irradiating means (60) is eliminated when the UV-ray emitting body is lighting, or generation of ozone is prevented when the UV-ray emitting body is lighting.

17 Claims, 6 Drawing Sheets

U.S. PATENT DOCUMENTS

2005/0154075 A1* 7/2005 Siegel ..... 522/8

FOREIGN PATENT DOCUMENTS

EP 1 156 603 11/2001
JP 04-106567 4/1992
JP 4-58350 5/1992
JP 2003-145741 5/2003
JP 2003-157965 * 5/2003

* cited by examiner

INK JET PRINTER USING UV INK

TECHNICAL FIELD

The invention relates to an ink jet printer using UV ink of a type that a UV-ray curing type UV-ink (ink irradiated with the UV rays to be cured) drop is shot from an ink jet head.

BACKGROUND ART

There is a known ink jet printer for shooting a UV-ray curing type UV-ink drop to a surface of a print media (which is a storage media and simply referred to as a media, hereinafter) mounted on a platen from a nozzle arranged in a lower surface of the ink jet head relatively moved in an X-Y (lengthwise and crosswise) direction substantially parallel to a surface of the platen over the media.

In the printer, provided is a UV-ray irradiating means for curing a UV-ink drop, which is shot at the surface of the media from the ink jet head, by irradiating it with UV-rays. The UV-ray irradiating means is used for irradiating the UV-ink drop shot at the surface of the media with UV-rays to instantly cure the UV-ink drop so as to fix the UV-ink drop to the media. The UV-ink drop shot at the surface of the media then widely spreads on the media in the vicinity of the shot place to prevent a blurred ink dot having a large diameter from being formed on the surface of the media.

In accordance with the ink jet printer comprising the UV-ray irradiating means, the UV-ink drop shot at the surface of the media is prevented from widely spreading on the media in the vicinity of the shot place. This allows a sharp and clear illustration and/or character in the arrangement of plural UV-ink dots having a small diameter to be printed without a blur.

Further, in accordance with the ink jet printer using the UV ink, an illustration and/or a character can be directly printed with the UV ink on the surface of various kinds of media such as a plastic sheet, a metal plate, a glass plate, a paper sheet and a piece of cloth without forming an ink receiving layer on the surface of the media.

DISCLOSURE OF THE INVENTION

Problems that the Invention is to Solve

In the conventional ink jet printer using the UV ink, however, a large-sized high-pressure mercury lamp or metal halide lamp is mainly used for a UV-ray emitting body of the UV-ray irradiating means.

This causes the UV-ray irradiating means housing the large-sized UV-ray emitting body to be large-sized. As a result, the ink jet printer using the UV ink per se also requires a large occupational space, and thereby, is large-sized.

Further, the high-pressure mercury lamp or the metal halide lamp used as the UV-ray emitting body consumes great power and generates a large quantity of ozone.

Moreover, the high-pressure mercury lamp or the metal halide lamp used as the UV-ray emitting body requires waiting time of 15 minutes or more until it is completely lighted. Accordingly, in the printer using the UV ink, the high-pressure mercury lamp or the metal halide lamp of the UV-ray irradiating means should be lighted constantly. On the other hand, the UV-ray irradiating means using the high-pressure mercury lamp or the metal halide lamp used as the UV-ray emitting body should be provided with a cover for covering the UV-ray emitting body, a shutter for opening/closing an opening of the cover and an opening/closing means for the shutter. The opening of the cover in which the UV-ray emitting body is housed should be opened or closed by means of the shutter for irradiation with the UV rays emitted from the UV-ray emitting body outward from the cover or to stop irradiation of the UV rays emitted from the UV-ray emitting body outward from the cover. Accordingly, in the printer using the UV ink, the UV irradiating means should be provided with the cover, the shutter and the opening/closing means for the shutter in addition to the large-sized UV-ray emitting body, so that the UV irradiating means becomes large in size and weight. As a result, when the UV-ray irradiating means relatively moves in the X-Y direction over the media mounted on the platen in one body with the ink jet head, a moving means of the ink jet head becomes large in size and consumes great power. Similarly, when the UV-ray irradiating means relatively moves in the X-Y direction over the media mounted on the platen separately from the ink jet head, a moving means of the UV-ray irradiating means becomes large in size and consumes great power.

An object of the invention is to provide an ink jet printer using the UV ink (simply refer to as an ink jet printer, hereinafter) capable of solving such problems.

Means for Solving the Problems

For the purpose of achieving the object, in an ink jet printer in accordance with the invention, a UVLED (an abbreviation of an ultra violet light emitting diode) or an array unit of UVLEDs (where plural UVLEDs is arranged in an array) is used as a UV-ray emitting body of a UV-ray irradiating means for irradiating with the UV rays the UV-ink drop shot on the surface of a media mounted on a platen from an ink jet head relatively moving in an X-Y direction substantially parallel to a surface of the platen over the media mounted on the platen.

The UVLED, which is a high-power ultra violet light emitting diode having been developed recently by Nichia Corporation, is so small in power consumption in lighting that the power consumption is about one-twentieth of that of the above-mentioned high-pressure mercury lamp or metal halide lamp. The UVLED is also greatly smaller than the above-mentioned high-pressure mercury lamp or a metal halide lamp in size and weight. Moreover, the above-mentioned high-pressure mercury lamp or a metal halide lamp generates ozone when it is lighting while the UVLED generates no ozone even in lighting. In addition, the UVLED can be repeatedly lighted or lighted out instantly without waiting time by controlling increase or decrease of a flow of an electric current inputted thereto.

Therefore, in accordance with the ink jet printer according to the invention, the ink jet printer comprising a UVLED or an array unit of UVLEDs as a UV-ray emitting body of the UV-ray irradiating means, it is possible to provide an energy-saving printer in which power consumption of the UV-ray emitting body of the UV-ray irradiating means is suppressed. The UV-ray irradiating means can be also greatly reduced in size and weight. This allows a printer comprising the UV-ray irradiating means to be reduced in size to scale down an occupational space thereof. In the case that the UV-ray irradiating means relatively moves in one body with the ink jet head in the X-Y direction over the media mounted on the platen, the moving means of the ink jet head moving in one body with the UV-ray irradiating means can be reduced in size and power consumption. Similarly, in the case that the UV-ray irradiating means relatively moves in the X-Y direction over the media mounted on the platen separately from the ink jet head, the moving means of the UV-ray irradiating means can be reduced in size and power consumption. Further, the UVLED or the array unit of UVLEDs used as the UV-ray emitting body of the UV-ray irradiating means can be prevented from generating ozone when the UVLED or the array unit of UVLEDs of the UV-ray irradiating means is lighted.

This contributes to provide a pollution-free printer generating no ozone. Additionally, controlling increase or decrease of a flow of an electric current inputted to the UVLED or the array unit of UVLEDs of the UV-ray irradiating means allows the UVLED or the array unit of UVLEDs to be repeatedly lighted or lighted out instantly without waiting time. As a result, it is unnecessary to provide in the UV-ray irradiating means a cover for covering around the UV-ray emitting body, a shutter for opening/closing an opening of the cover and an opening/closing means for the shutter for the purpose of irradiation with the UV ray from the UV-ray irradiating means outward from the UV-ray irradiating means or for the purpose of stopping irradiation with the UV ray from the UV-ray irradiating means outward from the UV-ray irradiating means. Accordingly, the UV-ray irradiating means can be reduced in size and weight and simplified.

In the ink jet printer in accordance with the invention, provided may be a controlling means for controlling increase or decrease of an electric current inputted to the UVLED or the array unit of UVLEDs of the UV-ray irradiating means so that the controlling means would increase or decrease the electric current inputted to the UVLED or the array unit of UVLEDs of the UV-ray irradiating means. Timing of UV-ray emission from the UVLED or the array unit of UVLEDs and intensity and duration of UV-ray emission from the UVLED or the array unit of UVLEDs are adjusted freely and precisely in accordance with timing or quantity of a UV-ink drop shot at the surface of the media.

In the ink jet printer using the array unit of UVLEDs as the UV-ray emitting body of the UV-ray irradiating means according to the invention, each of the plural UVLEDs arranged in the array unit of UVLEDs and radiating the UV rays substantially equal in quantity may be provided at the respective apexes of equilateral triangles, the equilateral triangles being equal in size and arranged on a plane substantially parallel to the surface of the platen with no space therebetween, so that a distance between the respective UVLEDs adjacent to each other would be equal. The distance between the respective plural adjacent UVLEDs of the array unit of UVLEDs arranged in an array on a plane substantially parallel to the surface of the platen and emitting the UV rays equal in quantity, is made equal while the plural UVLEDs are provided with a substantially even density at all places on the plane substantially parallel to the surface of the platen. On the other hand, the respective plural UVLEDs arranged in the array unit of UVLEDs are arranged in an array on a plane substantially parallel to the surface of the platen to be a substantially same distance away from the surface of the media mounted on the platen. The quantity of the UV rays, which are radiated from the respective plural UVLEDs arranged in the array unit of UVLEDs and with which the surface of the media mounted on the platen is widely irradiated in the lengthwise and crosswise direction, is evened so as to be substantially same at the all places on a part of the surface of the media, the part being exposed to the UV rays. The UV rays radiated from the array unit of UVLEDs to be used for even and wide irradiation of the surface of the media in the lengthwise and crosswise direction are used for instantly and sufficiently curing all of the ink drops shot at the respective places of a part of the surface of the media irradiated with the UV rays in a predetermined arranging pattern to certainly fix the ink drops to the media.

The UVLED emitting the UV rays or the respective plural UVLEDs arranged in the array unit of UVLEDs of the UV-ray irradiating means gradually rise in temperature due to the heat generated from the UVLED or the respective plural UVLEDs itself as the time passes. This causes gradual attenuation of the quantity of radiation of the UV rays radiated from the UVLED or the array unit of UVLEDs. This disables the ink drop shot at the surface of the media to be instantly and sufficiently cured to be fixed to the media by means of the UV rays with which the surface of the media is irradiated from the UVLED or the array unit of UVLEDs.

Accordingly, in order to solve such a problem, the ink jet printer according to the invention, preferably comprises: a detecting means for detecting a temperature of the UVLED of the UV irradiating means emitting the UV rays or at least one or more of the plural UVLEDs arranged in the array unit of UVLEDs of the UV irradiating means and radiating the UV rays substantially equal in quantity; and an adjusting means for increasing or decreasing electric energy supplied to the UVLED or the respective plural UVLEDs arranged in the array unit of UVLEDs in accordance with a change in temperature of the UVLED detected by means of the detecting means to keep constant the quantity of radiation of the UV rays emitted from the UVLED or the respective plural UVLEDs arranged in the array unit of UVLEDs without any influence of a change in temperature of the UVLED or the respective plural UVLEDs arranged in the array unit of UVLEDs emitting the UV rays. The electric energy to be supplied to the UVLED or the respective plural UVLEDs arranged in the array unit of UVLEDs is increased or decreased by means of the adjusting means in accordance with a change in temperature of the UVLED emitting the UV rays or the respective plural UVLEDs arranged in the array unit of UVLEDs and radiating the UV rays substantially equal in quantity, the change being detected by means of the detecting means. The quantity of radiation of the UV rays emitted from the UVLED or the respective plural UVLEDs arranged in the array unit of UVLEDs is kept constant without any influence of a change in temperature (a rise in temperature) of the UVLED radiating the UV rays or the respective plural UVLEDs arranged in the array unit of UVLEDs.

It is also preferable to provide a cooling means for cooling the UVLED emitting the UV rays or the respective plural UVLEDs arranged in the array unit of UVLEDs and radiating the UV rays substantially equal in quantity. The UVLED emitting the UV rays or the respective plural UVLEDs arranged in the array unit of UVLEDs is continuously cooled by means of the cooling means so that the heat generated by the UVLED or the respective plural UVLEDs arranged in the array unit of UVLEDs would be continuously radiated to the outside of the UVLED. This prevents gradual attenuation of the quantity of radiation of the UV rays radiated from the UVLED or the array unit of UVLEDs arranged in the array unit of UVLEDs because of a gradual rise in temperature due to the heat generated by the UVLED or the respective plural UVLEDs arranged in the array unit of UVLEDs itself.

The quantity of the UV rays, which is radiated from the UVLED or the array unit of UVLEDs and with which the surface of the media is irradiated, is always kept constant regardless of the passage of time. The UV rays always radiated in a constant quantity from the UVLED or the array unit of UVLEDs regardless of the passage of time to be used for continuous irradiation of the surface of the media are used for instantly and sufficiently curing the ink drop shot at the surface of the media at all times regardless of the passage of time so that the ink drop would be certainly fixed to the media.

A proper quantity of irradiation of the media with the UV rays is 200 to 1500 mJ/cm$^2$.

BEST MODE FOR CARRYING OUT THE INVENTION

Now, the best mode for carrying out the invention will be described in accordance with the drawings.

Figure 1:
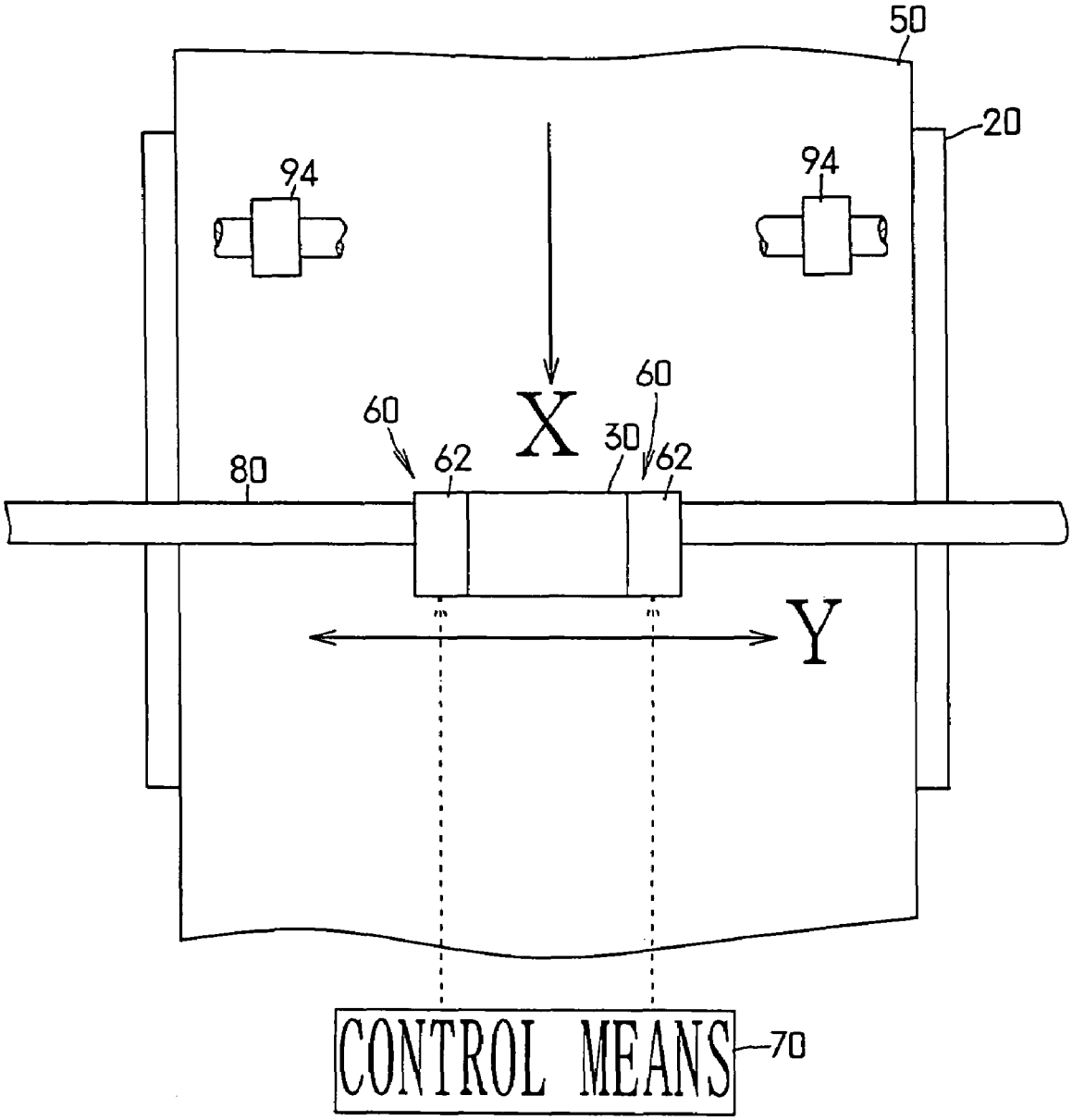
FIG. 1 is a schematic plan view showing a structure of an ink jet printer in accordance with the invention.
Figure 2:
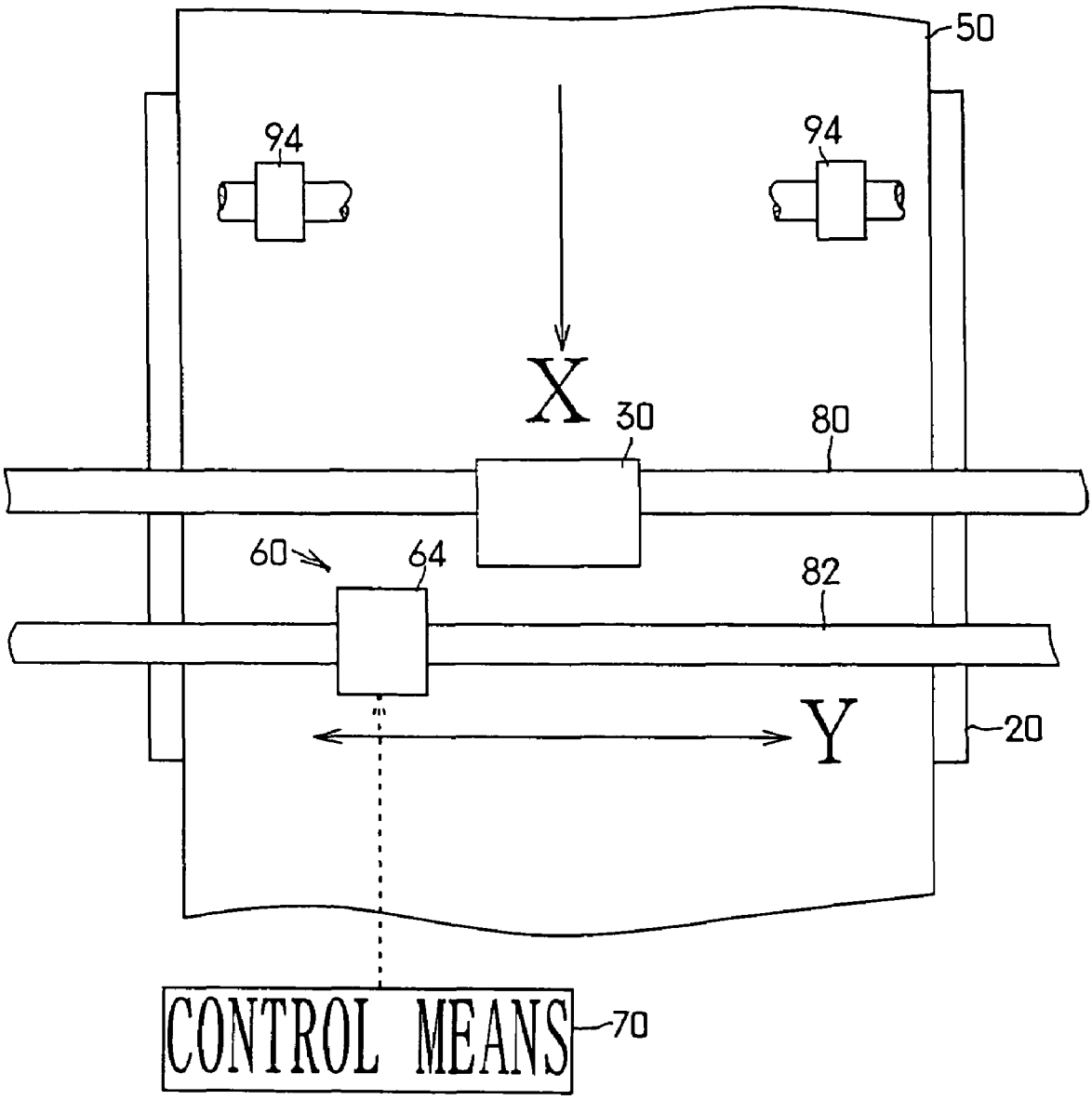
FIG. 2 is a schematic plan view showing a structure of an ink jet printer in accordance with the invention.
Figure 3:
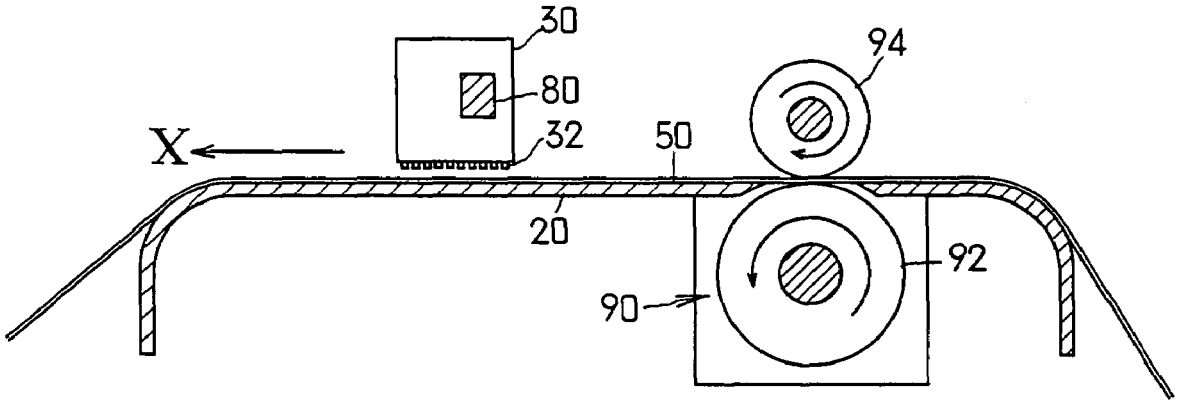
FIG. 3 is a schematic side view showing a structure of an ink jet printer in accordance with the invention.

FIGS. 1 to 3 show preferred embodiments of an ink jet printer according to the invention.

Printers shown in FIGS. 1 and 2 are arranged so that a UV-ink drop shot from nozzles 32 at a surface of a media 50, the nozzles 32 being provided in a lower surface of an ink jet head 30 relatively moving in an X-Y (lengthwise and crosswise) direction substantially parallel to a surface of a platen 20 over the media 50 mounted on the platen 20, would be irradiated with UV-rays by means of a UV-ray irradiating means 60 to cure the UV-ink drop on the surface of the media 50. The printers are also arranged so that illustration and/or character in the arrangement of plural UV-ink dots would be printed on the surface of the media 50.

The ink jet head 30 is arranged to move in a Y (width) direction along a guide rail 80, which is provided in the Y direction over the platen 20, over the media 50 mounted on the platen 20.

On the other hand, as shown in FIG. 3, the media 50 is arranged to be sandwiched between a feeding roller 92 and a pressing roller 94 of a carrying means 90 oppositely provided on the upper and lower sides of the platen 20 to be moved in an X (length) direction over the platen 20 by rotating the feeding roller 92 in an X direction (in a direction shown by an arrow in the drawings). The ink jet head 30 is arranged to relatively move in the X-Y direction over the media 50 mounted on the platen 20.

The UV-ray irradiating means 60 is arranged to relatively move in the X-Y (lengthwise and crosswise) direction over the media 50 mounted on the platen 20, similarly to the ink jet head 30.

Concretely, in the ink jet printer shown in FIG. 1, the UV-ray irradiating means 60 are provided on the both sides of the ink jet head 30 in one body with the ink jet head 30. The UV-ray irradiating means 60 are relatively moved in the X-Y direction over the media 50 mounted on the platen 20 in one body with the ink jet head 30. The UV-ink drop shot from the ink jet head 30 at the surface of the media 50, the UV-ink drop being shot at the surface of the media 50 exposed on the lower left or right side of the ink jet head 30 running in the Y direction, is irradiated with UV rays by means of the UV-ray irradiating means 60 provided on the both sides of the ink jet head 30.

On the other hand, in the ink jet printer shown in FIG. 2, the UV-ray irradiating means 60 is arranged to move in the Y direction over the media 50 mounted on the platen 20 along a sub guide rail 82, which is provided in the Y direction over the platen 20, separately from the ink jet head 30. The UV-ink drop shot from the ink jet head 30 at the surface of the media 50, the UV-ink drop being shot from the lower side of a running path of the ink jet head 30 at the surface of the media 50 carried to a front side of the platen 20 in the X direction over the platen 20 by means of the carrying means 90, is irradiated with UV rays by means of the UV-ray irradiating means 60 running in the Y direction on a front side of the ink jet head 30.

The above-mentioned structures are same as a conventional ink jet printer described above. In the ink jet printer shown in FIG. 1, however, a UVLED 62 is used as a UV-ray emitting body of the UV-ray irradiating means 60. On the other hand, in the jet printer shown in FIG. 2, an array unit 64 of UVLEDs (in which plural UVLEDs are arranged in an array) is used as the UV-ray emitting body of the UV-ray irradiating means 60. For the UVLED 62 or the UVLEDs 62 arranged in the array unit 64 of UVLEDs, used is a high-power UV-ray emitting device made by Nichia Corporation mentioned above. Concretely, NCCU001E (product name), the high-power UV-ray emitting device made by Nichia Corporation, the emitting device being for emitting the UV rays having a wavelength of about 380 nm, is used as the UVLED 62 of the UV-ray irradiating means 60 provided in one body on the both sides of the ink jet head 30 of the ink jet printer in FIG. 1. On the other hand, as the UVLED 62 arranged in the array unit 64 of UVLEDs of the UV-ray irradiating means 60 of the ink jet printer in FIG. 2, used is a NCCU033E (product name), the high-power UV-ray emitting device made by Nichia Corporation, the emitting device being for emitting the UV rays having a wavelength of about 365 nm. For the UVLED 62, a UVLED made by a company other than Nichia Corporation may be used, of course. Further, as a UV-ray emitting body of the UV irradiating means 60 provided on the both sides of the ink jet head 30 in FIG. 1, used can be an array unit of UVLEDs. Similarly, as a UV-ray emitting body of the UV-ray irradiating means 60 provided separately from the ink jet head 30 in FIG. 2, used can be a large-scaled UVLED.

In the ink jet printers shown in FIGS. 1 and 2, a characteristic of the UVLED 62 or the array unit 64 of UVLEDs used in the UV-ray irradiating means 60 allows an energy-saving ink jet printer in which power consumption of the UV-ray emitting body of the UV-ray irradiating means 60 is suppressed to be provided. Further, the UV-ray irradiating means 60 is greatly reduced in size and weight, so that the ink jet printer comprising the UV-ray irradiating means 60 can be miniaturized and reduced in size. On the other hand, the moving means of the ink jet head 30 provided in one body with the UV-ray irradiating means 60 or the moving means of the UV-irradiating means 60 provided separately from the ink jet head 30 is miniaturized so as to be able to reduce power consumption thereof. Moreover, the UV-ray irradiating means 60 can be prevented from generating ozone when the UVLED 62 or the array unit 64 of UVLEDs, which is used as the UV-ray emitting body of the UV-ray irradiating means 60, is lighted. This allows a pollution-free ink jet printer generating no ozone to be provided. In addition, controlling increase or decrease of an electric current inputted to the UVLED 62 or the array unit 64 of UVLEDs used as the UV-ray emitting body of the UV-ray irradiating means 60 can repeatedly light or light out the UVLED 62 or the array unit 64 of UVLEDs instantly without waiting time. As a result, it becomes unnecessary to provide in the UV-ray irradiating means 60 a cover for covering around the UV-ray emitting body, a shutter for opening/closing an opening of the cover and an opening/closing means for the shutter. This allows the UV-ray irradiating means 60 to be reduced in size and weight and simplified.

In the above-mentioned ink jet printers, it is preferable to provide a controlling means 70 comprising an electronic circuit or the like, which controls increase or decrease of an electric current inputted to the UVLED 62 or the array unit 64 of UVLEDs of the UV-ray emitting body, as shown in FIGS. 1 and 2. The controlling means 70 can increase or decrease an electric current inputted to the UVLED 62 or the array unit 64 of UVLEDs of the UV-ray irradiating means 60 so as to freely and precisely adjust timing of UV-ray emission from the UVLED 62 or the array unit 64 of UVLEDs and intensity and duration of UV-ray emission from the UVLED 62 or the array unit 64 of UVLEDs in accordance with timing or quantity of a UV-ink drop shot at the surface of the media 50. This allows the UV-ink drop shot at the surface of the media 50 to be precisely cured neither too much nor too little with good timing.

Figure 4:
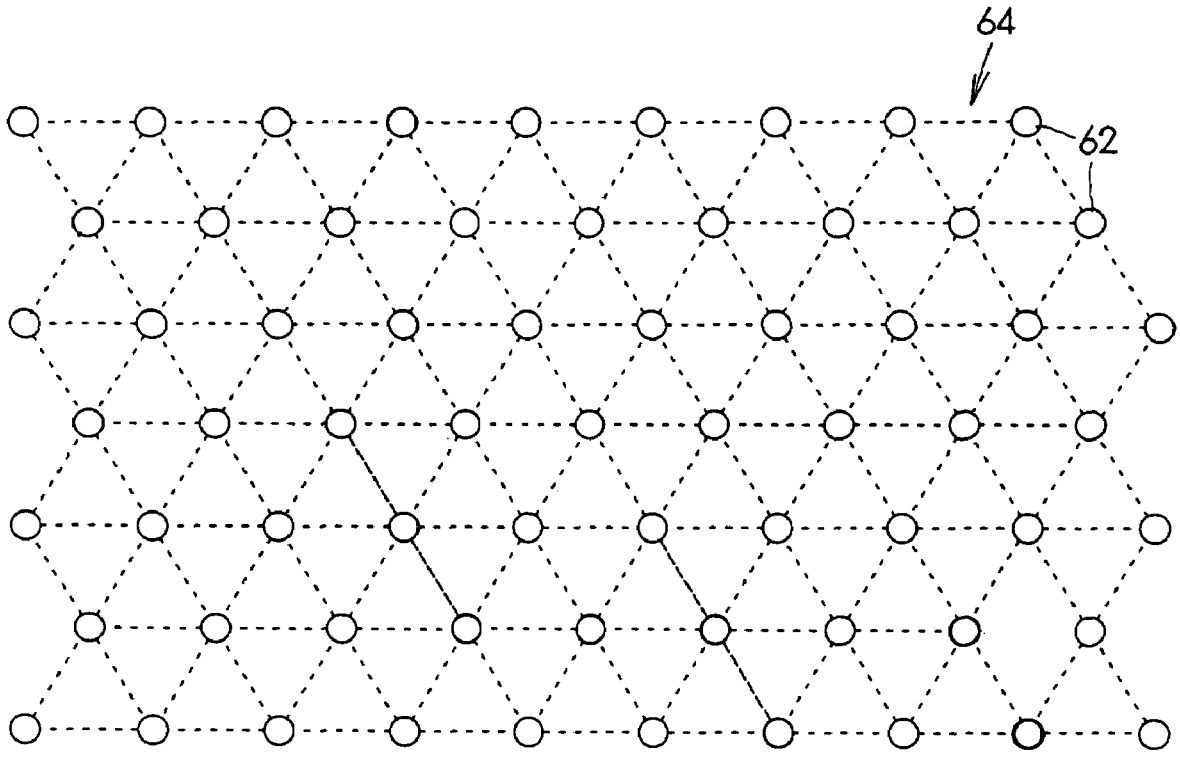
FIG. 4 illustrates a structure of an array unit of UVLEDs of an ink jet printer in accordance with the invention.

In the ink jet printer using the array unit 64 of UVLEDs as the UV-ray emitting body of the UV-ray irradiating means 60, the array unit 64 of UVLEDs is preferably formed by arranging plural UVLEDs 62 emitting UV rays substantially equal in quantity on a plane substantially parallel to the surface of the platen 20, as shown in FIG. 4. In this case, each of the plural UVLEDs 62 arranged in the array unit 64 of UVLEDs is provided at the respective apexes of equilateral triangles shown by a broken line, the equilateral triangles being equal in size and arranged on a plane substantially parallel to the surface of the platen 20 with no space therebetween, so that a distance between the respective UVLEDs 62 adjacent to each other would be equal. The respective plural UVLEDs 62 of the array unit 64 of UVLEDs are arranged with a substantially even density at all places on the plane substantially parallel to the surface of the platen 20 while the respective plural UVLEDs 62 arranged in the array unit 64 of UVLEDs are provided a substantially same distance away from the surface of the media 50 mounted on the platen 20. UV-ray radiating parts of the respective plural UVLEDs 62 arranged in the array unit 64 of UVLEDs are faced to the platen 20. The surface of the media 50 mounted on the platen 20 is arranged to be precisely irradiated with the UV rays emitted from the respective plural UVLEDs 62 arranged in the array unit 64 of a UVLED. The quantity of the UV rays, which are radiated from the respective plural UVLEDs 62 arranged in the array unit 64 of UVLEDs and with which the surface of the media 50 mounted on the platen 20 is irradiated widely in the lengthwise and crosswise direction, is evened so as to be substantially equal in all places of a part of the surface of the media 50, the part being irradiated with the UV rays. The UV rays radiated from the array unit 64 of UVLEDs are used to instantly and sufficiently cure all of the ink drops shot at every place of the surface of the media 50 in a predetermined arranging pattern so as to enable the ink drops to be certainly fixed to the media 50.

Figure 5:
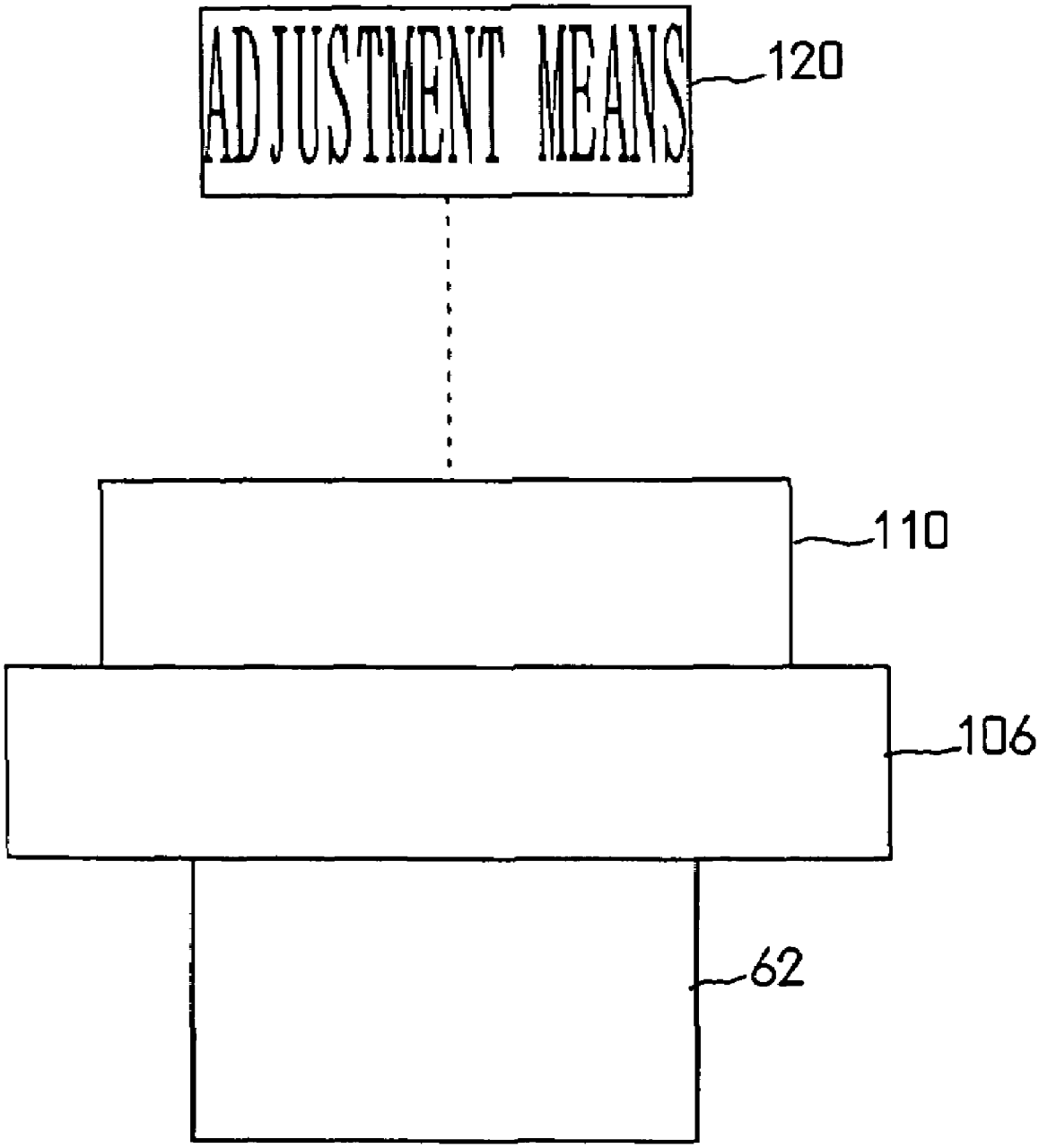
FIG. 5 structurally illustrates the vicinity of a detecting means of an ink jet printer of the invention.

In the ink jet printer shown in FIGS. 1 and 2, it is preferable to provide a detecting means 110 for detecting a temperature of the UVLED 62 emitting the UV rays or at least one or more UVLED 62 of the plural UVLEDs 62, which are arranged in the array unit 64 of UVLEDs and which radiate the UV rays substantially equal in quantity, of the UV-ray irradiating means 60, as shown in FIG. 5. The detecting means 110 can be formed from a thermocouple sensor and an electronic circuit in combination, for example. The detecting means 110 can be attached to a substrate 106, which is made of alumina ceramic, metal or the like and on which the UVLED 62 is mounted. The detecting means 110 is used for detecting a temperature of at least one or more UVLED 62 of the plural UVLEDs 62 arranged in the array unit 64 of UVLEDs since the respective plural UVLEDs 62 arranged in the array unit 64 of UVLEDs are supposed to have a structure of radiating the UV rays equal in quantity and to generate heat to rise to a substantially same temperature at a substantially same speed. Accordingly, it can be presumed that, when a temperature of the at least one or more UVLED 62 arranged in the array unit 64 of UVLEDs is detected by means of the detecting means 110, a temperature of the UVLED 62 arranged in the array unit 64 of UVLEDs other than the at least one or more UVLED 62 is substantially same as the temperature of the at least one or more UVLED 62, which is detected by means of the detecting means 110.

On the other hand, it is preferable to provide an adjusting means 120 for increasing or decreasing electric energy to be supplied to the UVLED 62 emitting the UV rays or the respective plural UVLEDs 62 arranged in the array unit 64 of UVLEDs in accordance with the change in temperature of the UVLED 62 emitting the UV rays, which is detected by means of the detecting means 110. The adjusting means 120 can comprise a power supply circuit for supplying the UVLED 62 with electric energy and an electronically controlling circuit connected to an electronic circuit of the detecting means 110 for controlling drive of the power supply circuit, for example.

The adjusting means 120 is arranged to control at least one of a voltage, a current, a width of a current-carrying pulse or a cycle of a current-carrying pulse, which is supplied to the UVLED 62 or the respective plural UVLEDs 62 arranged in the array unit 64 of UVLEDs, for example, to keep the quantity of radiation of the UV rays emitted from the UVLED 62 or the respective plural UVLEDs 62 arranged in the array unit 64 of UVLEDs constant regardless of a rise in temperature of the UVLED 62 emitting the UV rays.

In accordance with a rise in temperature of the UVLED 62 emitting the UV rays or the respective plural UVLEDs 62 arranged in the array unit 64 of a UVLEDs and radiating the UV rays substantially equal in quantity, the temperature being detected by means of the detecting means 110, the adjusting means 120 increases electric energy supplied to the UVLED 62 of the respective plural UVLEDs 62 arranged in the array unit 64 of UVLEDs. The quantity of radiation of the UV rays emitted from the UVLED 62 or the respective plural UVLEDs 62 arranged in the array unit 64 of UVLEDs can be kept constant without any influence by a rise in temperature of the UVLED 62 emitting the UV rays or the respective plural UVLEDs 62 arranged in the array unit 64 of UVLEDs. The UV rays always radiated in a constant quantity from the UVLED 62 or the array unit 64 of UVLEDs regardless of the passage of time are used for instantly and sufficiently curing the ink drop shot at the surface of the media 50 at all times regardless of the passage of time so as to be certainly fixed to the media 50.

Figure 6:
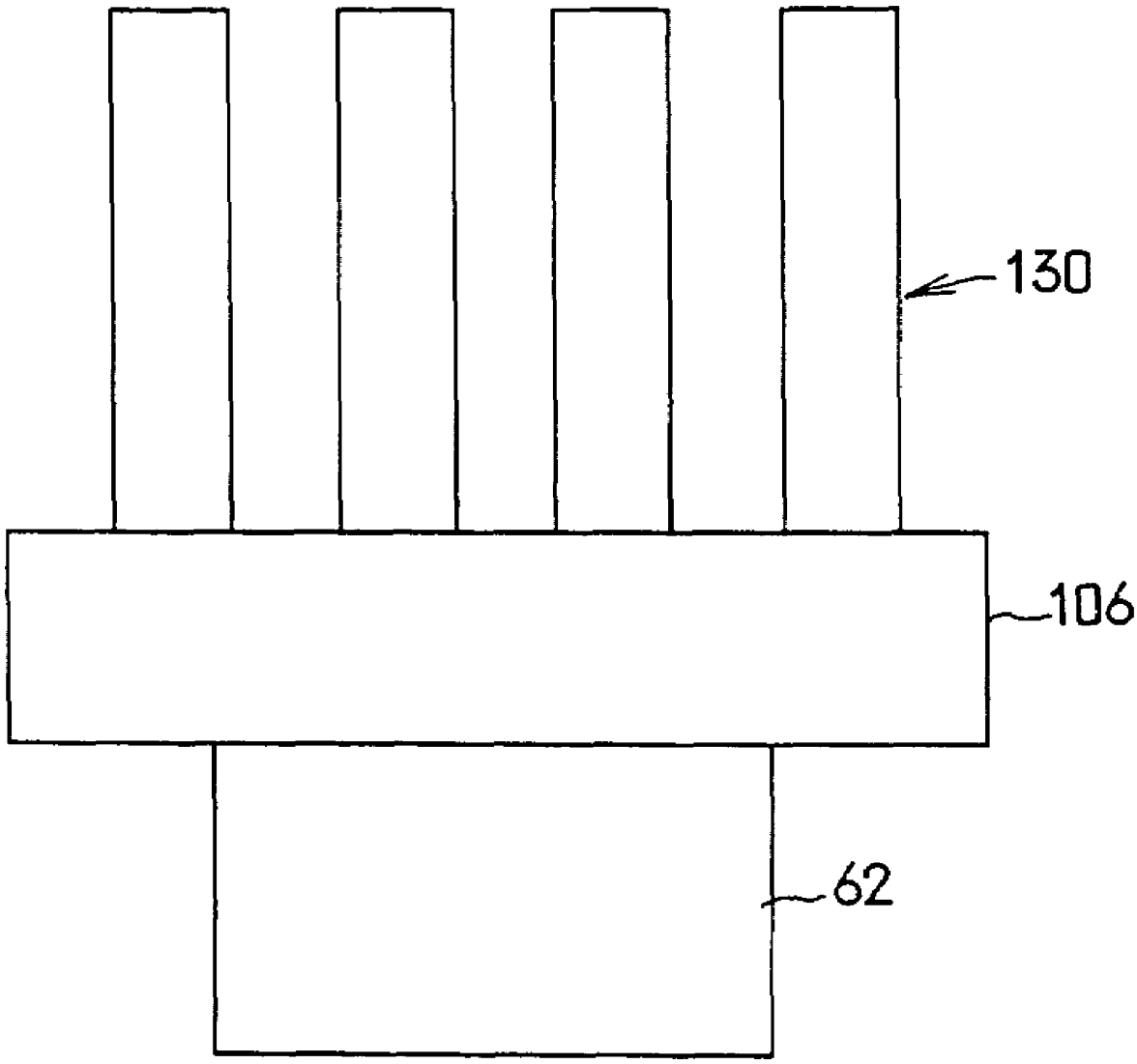
FIG. 6 structurally illustrates the vicinity of a cooling means of an ink jet printer of the invention.

In the ink jet printer shown in FIGS. 1 and 2, it may be possible to provide a cooling means 130 for cooling the UVLED 62 emitting the UV rays or the respective plural UVLEDs 62 arranged in the array unit 64 of UVLEDs and radiating the UV rays substantially equal in quantity to keep constant the quantity of radiation of the UV rays emitted from the UVLED 62 or the respective plural UVLEDs 62 arranged in the array unit 64 of UVLEDs instead of the detecting means 110 and the controlling means 120, as shown in FIG. 6.

For the cooling means 130, used can be a thermoelectric cooling device (a radiation fin in the drawings) referred to as a heat-radiating fin or a Peltier device, for example. The radiation fin or the thermoelectric cooling device can be attached to a substrate 106, which is made of alumina ceramic, metal or the like superior in radiation characteristic and on which the UVLED 62 is mounted, as shown in FIG. 6. It can be arranged that the radiation fin or the thermoelectric cooling device allow the heat emitted from the UVLED 62 mounted on the substrate 106 to be efficiently radiated to the outside.

The cooling means 130 is preferably used to continuously cool the UVLED 62 emitting the UV rays or the respective plural UVLEDs 62 arranged in the array unit 64 of UVLEDs and radiating the UV rays substantially equal in quantity. The heat generated by the UVLED 62 or the respective plural UVLEDs 62 arranged in the array unit 64 of UVLEDs is preferably continuously radiated to the outside with efficiency. This preferably prevents the quantity of radiation of the UV rays emitted from the UVLED 62 from being attenuated gradually because of a gradual rise in temperature due to the heat generated by the UVLED 62 itself. The UV rays always radiated in a constant quantity regardless of the passage of time from the UVLED 62 or the respective plural UVLEDs 62 arranged in the array unit 64 of UVLEDs, which is continuously cooled to be in a condition of a low temperature, are used for instantly and sufficiently curing the ink drop shot at the surface of the media 50 at all times regardless of the passage of time so that the ink drop would be certainly fixed to the media 50.

The structures shown in FIGS. 4 to 6 are both applicable to an ink jet printer using the array unit 64 of UVLEDs as the UV-ray emitting body of the UV-ray irradiating means 60.

That is to say, in such a case, the quantity of the UV rays, which are radiated from the respective plural UVLEDs 62 arranged in the array unit 64 of UVLEDs and radiating the UV rays substantially equal in quantity and with which the surface of the media 50 mounted on the platen 20 is widely irradiated in the lengthwise and crosswise direction, can be evened so as to be substantially equal at all places of a part of the surface of the media 50, the part being irradiated with the UV rays.

Additionally, the irradiation quantity of the UV rays, which are emitted from the respective plural UVLEDs 62 arranged in the array unit 64 of UVLEDs and emitting the UV rays, can be prevented from being gradually attenuated as the time passes.

It is also possible to use a structure shown in FIG. 4 and any one of structures shown in FIGS. 5 and 6 together for an ink jet printer using the array unit 64 of UVLEDs as the UV-ray emitting body of the UV irradiating means 60.

That is to say, in such a case, the quantity of the UV rays, which are radiated from the respective plural UVLEDs 62 arranged in the array unit 64 of UVLEDs and with which the surface of the media 50 mounted on the platen 20 is widely irradiated in the lengthwise and crosswise direction, can be evened so as to be substantially equal at all places of a part of the surface of the media 50, the part being irradiated by the UV rays.

Additionally, the irradiation quantity of the UV rays, which are emitted from the respective plural UVLEDs 62 arranged in the array unit 64 of UVLEDs and emitting the UV rays, can be prevented from being gradually attenuated as the time passes.

It is further also possible to use structures shown in FIGS. 5 and 6 together for an ink jet printer using the UVLED 62 or the array unit 64 of UVLEDs as the UV-ray emitting body of the UV-ray irradiating means 60.

That is to say, in such a case, the quantity of radiation of the UV rays emitted from the UVLED 62 emitting the UV rays or the respective plural UVLEDs 62 arranged in the array unit 64 of UVLEDs can be certainly prevented from being gradually attenuated as the time passes.

The ink jet printer in accordance with the invention is also applicable to a flat bed type ink jet printer in which a media is fixedly mounted on a flat bed-shaped platen so as not to move and an ink jet head for jetting a UV-ink drop over the media mounted on the platen is moved in the X-Y direction.

The UVLED used as the UV ray emitting body of the ink jet printer in accordance with the invention can be variously modified so long as the modification is carried out for the purpose of curing the UV ink. For example, it may be arranged that the array unit of UVLEDs of the UV-ray irradiating means be formed by arranging a large number of UVLEDs long in the Y direction over a width of the media to move the media in the X direction under the array unit of UVLEDs. The array unit of UVLEDs of the UV-ray irradiating means may be fixedly provided in the Y direction over the platen. Moreover, in printing a small-sized media such as a card, forming the array unit of UVLEDs of the UV-ray irradiating means by arranging plural UVLEDs in the lengthwise and crosswise direction in an area larger than the size of the card allows the plural UV-ink drops shot at a surface of the card in a predetermined arranging pattern to be cured at once by means of the array unit of UVLEDs.

A luminescence wavelength of the UV rays emitted from the UVLED used as the UV-ray irradiating means of the ink jet printer in accordance with the invention is not limited to a specific wavelength but can be any wavelength as long as the UV ink can be cured effectively in practice with the wavelength. For the purpose of preventing influence by the room light, however, a UVLED emitting the UV rays having the luminescence wavelength of 410 nm or less is suitable for the UVLED used as the UV-ray irradiating means of the ink jet printer in accordance with the invention.

Industrial Applicability

The ink jet printer in accordance with the invention is widely applicable to an ink jet printer using a UV ink in which a UV-curing type ink drop shot at a surface of a media from an ink jet head thereof is irradiated with the UV rays to be cured.

The invention claimed is:

1. An ink jet printer comprising:

a platen configured to receive a print media;

an ink jet head configured to shoot an ink drop at a surface of the print media, said ink jet head being configured to move substantially parallel to a surface of said platen over the print media on the platen, said ink jet head being configured to move in a transverse direction across said surface of said platen; and a multiplicity of UVLEDs configured to irradiate the ink drop on the surface of the print media with UV rays to cure the ink drop on the surface of the print media, the multiplicity of UVLEDs being arranged in an array at respective apexes of equilateral triangles, the equilateral triangles being equal in size and arranged on a plane substantially parallel to the surface of the platen so that distances between UVLEDs adjacent to each other are substantially equal.

2. The ink jet printer according to claim 1, further comprising means for increasing or decreasing an electric current input to said one or more UVLEDs to adjust timing, and/or duration of UV-ray emission from said one or more UVLEDs.

3. The ink jet printer according to claim 1, further comprising:

a temperature sensing device configured to detect a temperature of said one or more UVLEDs; and means for increasing or decreasing electric energy supplied to said one or more UVLEDs in accordance with a change in temperature of said one or more UVLEDs detected by said temperature sensing device to maintain a constant quantity of radiation of the UV rays emitted from said one or more UVLEDs.

4. The ink jet printer according to claim 1, further comprising:

a cooling device configured to cool said one or more UVLEDs to maintain a constant quantity of radiation of the UV rays emitted from said one or more UVLEDs.

5. The ink jet printer according to claim 1, wherein said one or more UVLEDs and said ink jet head are provided in a same body, said body being configured to move in the transverse direction across said surface of said platen.

6. The ink jet printer according to claim 1, further comprising:

a first guide rail extending across said platen; and a second guide rail extending across said platen, wherein said second guide rail is separate from said first guide rail, wherein said ink jet head is slidably mounted to said first guide rail and configured to slide along said first guide rail in a direction transverse to said platen, and wherein said one or more UVLEDs are slidably mounted to said second guide rail and configured to slide along said second guide rail in a direction transverse to said platen.

7. The ink jet printer according to claim 1, wherein said one or more UVLEDs are configured to irradiate the ink drop on the surface of the print media with UV rays to cure the ink drop on the surface of the print media with a quantity of irradiation of 200 to 1500 mJ/cm$^2$.

8. The ink jet printer according to claim 4, wherein said cooling device is a Peltier device.

9. The ink jet printer according to claim 5, wherein said one or more UVLEDs are configured to irradiate the ink drop on the surface of the print media with UV rays to cure the ink drop on the surface of the print media with a quantity of irradiation of 200 to 1500 mJ/cm$^2$.

10. An ink jet printer comprising:

a platen configured to receive a print media;

an ink jet head configured to shoot an ink drop at a surface of the print media, said ink jet head being configured to move substantially parallel to a surface of said platen over the print media on the platen;

a multiplicity of UVLEDs configured to irradiate the ink drop on the surface of the print media with UV rays to cure the ink drop on the surface of the print media, the multiplicity of UVLEDs being arranged in an array at respective apexes of equilateral triangles, the equilateral triangles being equal in size and arranged on a plane substantially parallel to the surface of the platen so that distances between UVLEDs adjacent to each other are substantially equal; and a Peltier cooling device configured to cool said one or more UVLEDs to maintain a constant quantity of radiation of the UV rays emitted from said one or more UVLEDs.

11. The ink jet printer according to claim 10, further comprising means for increasing or decreasing an electric current input to said one or more UVLEDs to adjust timing, intensity, and/or duration of UV-ray emission from said one or more UVLEDs.

12. The ink jet printer according to claim 10, further comprising a temperature sensing device configured to detect a temperature of said one or more UVLEDs.

13. The ink jet printer according to claim 10, wherein said one or more UVLEDs and said ink jet head are provided in a same body, said body being configured to move in the transverse direction across said surface of said platen.

14. The ink jet printer according to claim 10, wherein said one or more UVLEDs are configured to irradiate the ink drop on the surface of the print media with UV rays to cure the ink drop on the surface of the print media with a quantity of irradiation of 200 to 1500 mJ/cm$^2$.

15. The ink jet printer according to claim 10, further comprising:

a first guide rail extending across said platen; and a second guide rail extending across said platen, wherein said second guide rail is separate from said first guide rail, wherein said ink jet head is slidably mounted to said first guide rail and configured to slide along said first guide rail in a direction transverse to said platen, and wherein said one or more UVLEDs are slidably mounted to said second guide rail and configured to slide along said second guide rail in a direction transverse to said platen.

16. The ink jet printer according to claim 12, further comprising means for increasing or decreasing electric energy supplied to said one or more UVLEDs in accordance with a change in temperature of said one or more UVLEDs detected by said temperature sensing device to maintain a constant quantity of radiation of the UV rays emitted from said one or more UVLEDs.

17. The ink jet printer according to claim 13, wherein said one or more UVLEDs are configured to irradiate the ink drop on the surface of the print media with UV rays to cure the ink drop on the surface of the print media with a quantity of irradiation of 200 to 1500 mJ/cm$^2$.

* * * * *